US005273168A

United States Patent [19]

Stevens

[11] Patent Number: 5,273,168

[45] Date of Patent: Dec. 28, 1993

[54] FOLDING MULTI-POT HOLDER

[75] Inventor: Kenneth V. Stevens, Brooklyn, N.Y.

[73] Assignee: King Arthur Company, div. of Shelby Williams Industries, Inc., Statesville, N.C.

[21] Appl. No.: 971,306

[22] Filed: Nov. 4, 1992

[51] Int. Cl.[5] ..... A47F 7/00

[52] U.S. Cl. ..... 211/71; 211/85; 211/132

[58] Field of Search ..... 211/71, 81, 85, 132, 211/168, 170

[56] References Cited

U.S. PATENT DOCUMENTS

| | | | |
|---|---|---|---|
| 1,724,385 | 8/1929 | Weston | 211/85 X |
| 2,961,101 | 11/1960 | Hutton | 211/132 |
| 4,583,707 | 4/1986 | Anderson | 211/85 X |
| 5,048,857 | 9/1991 | Stevens | 211/71 X |

*Primary Examiner*—Alvin C. Chin-Shue
*Assistant Examiner*—Sarah A. Lechok
*Attorney, Agent, or Firm*—Ostrager, Chong & Flaherty

[57] ABSTRACT

A folding multi-pot holder has a holder member pivotably supported over a base member by opposing sets of legs pivotably mounted to the opposite ends of the base and holder members. The pivot points of each pair of legs are offset from each other by the thickness of the legs so that the legs can be pivotally folded to a flat, horizontal position for storage. In the preferred embodiment, the base member and holder member both have the same thickness which is twice the thickness of the legs so that the entire assembly folds flat to a single thickness for storage. Support members are provided for bracing the holder member at intermediate positions and have upright tabs that lock the holder member and legs in the vertical position during use.

8 Claims, 3 Drawing Sheets

FOLDING MULTI-POT HOLDER

FIELD OF THE INVENTION

This invention generally relates to a pot holder such as may be used on food service tables, and particularly to one capable of holding multiple pots and being conveniently folded for storage.

BACKGROUND ART

Food service tables and settings are widely used in hotel, meeting, and convention environments for providing hot and cold food and beverage service. It is important that the food service equipment be movable, durable, safe, and capable of convenient setup and storage. Conventional equipment includes various types of racks and holders for hot beverage containers, food trays, chafing trays, etc. However, such conventional equipment has the problem that they are not generally foldable and convenient to store.

SUMMARY OF THE INVENTION

In accordance with the present invention, a folding multi-pot holder comprises: a base member having opposite ends spaced apart by a given length in a lateral direction and having a given depth in a depthwise direction; a holder member spaced apart from the base member by a given height in a vertical direction and having opposite ends spaced apart by the given length in the lateral direction; and two sets of legs positioned respectively at the opposite ends of the base member and holder member for supporting the holder member in the vertical direction over the base member, wherein each set includes a pair of legs arranged upright in the vertical direction and spaced apart in parallel in the depthwise direction, each leg of said pair of legs having a given thickness in the depthwise direction and having a first end thereof pivotably mounted at a respective pivot point to a respective end of said base member and a second end thereof pivotably mounted at a respective pivot point to a respective end of said holder member, and further wherein the pivot points of each pair of legs mounted to the ends of said base member and said holder member are offset from each other by the given thickness in the vertical direction, such that the two pairs of legs with said holder member can be pivotally folded on said base member from the vertical direction to a flat, horizontal position in the depthwise direction for storage.

In the preferred embodiment, the base member and holder member both have the same thickness which is twice the thickness of the pivotably mounted legs so that the entire assembly has a single thickness when folded flat for storage. Intermediate support members for bracing the holder member at intermediate positions are pivotably mounted on the base member, so that they can be folded flat on the base member for storage, and have a pair of upright tabs that fit snugly onto opposite sides of the holder member in the depthwise direction in order to lock the holder member and legs in a vertical position during use.

Other objects, features and advantages of the present invention will be apparent from the following detailed description of the preferred embodiments with reference to the drawings, of which:

DETAILED DESCRIPTION OF THE INVENTION

Figure 1:
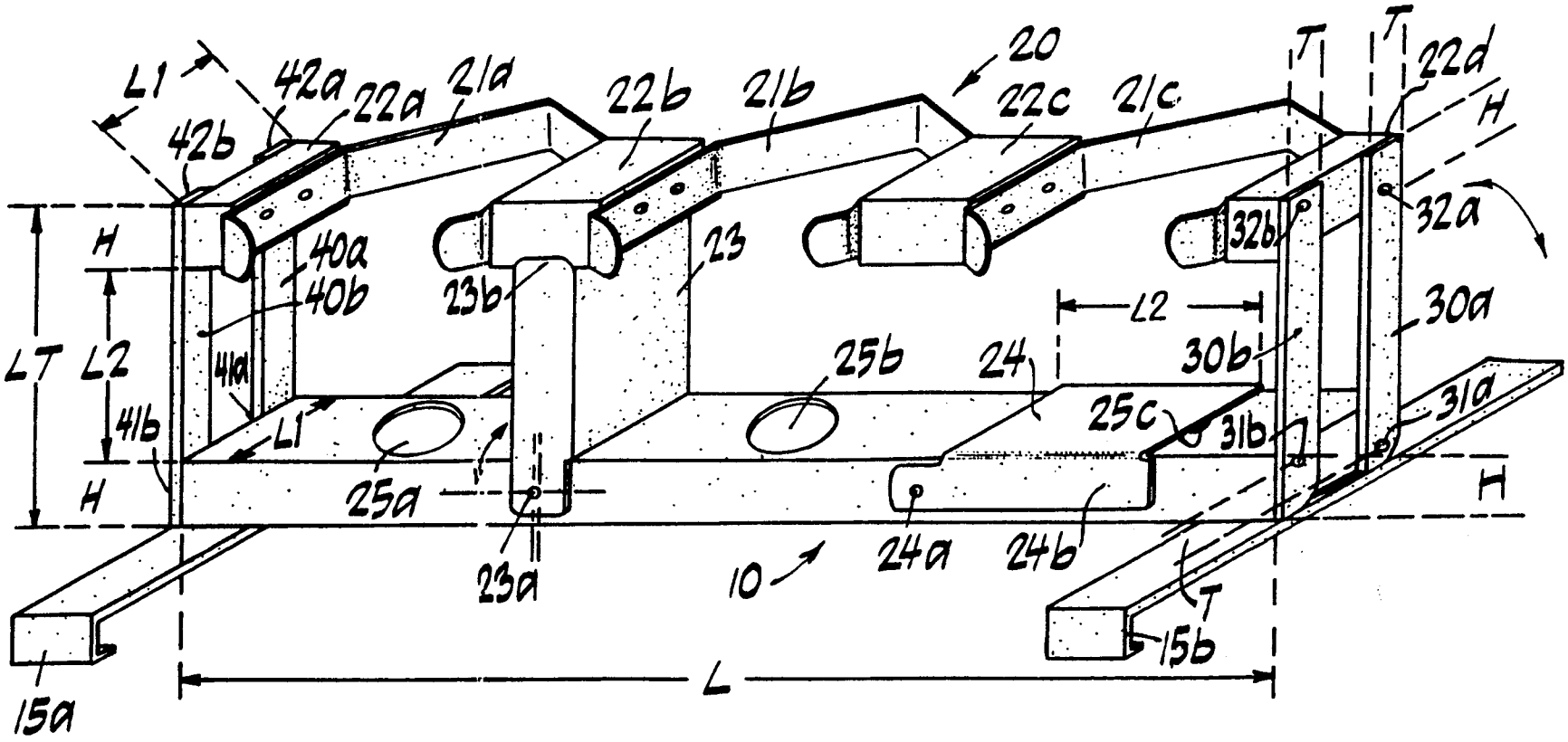
FIG. 1 is a perspective view of a preferred embodiment of a folding multi-pot holder in accordance with the present invention.
Figure 2:
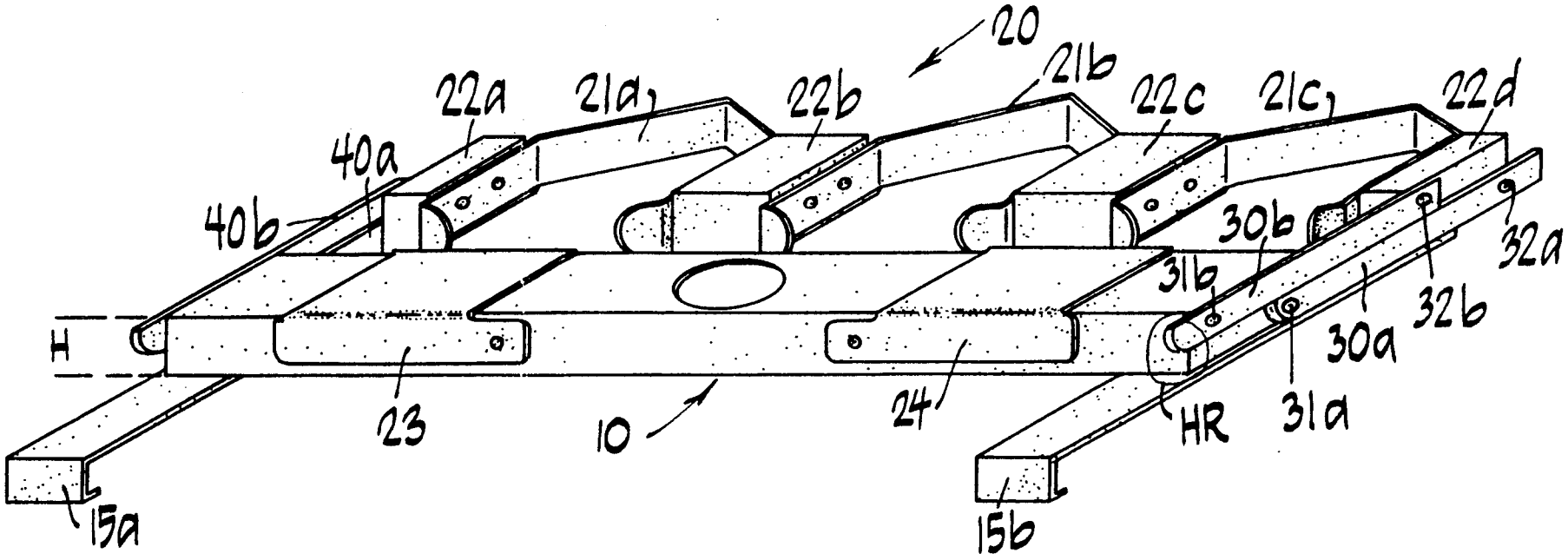
FIG. 2 shows the multi-pot holder of FIG. 1 folded to a flat, horizontal position for storage.

In FIGS. 1 and 2, a preferred embodiment of a folding multi-pot holder in accordance with the invention is shown having a base member 10, a holder member 20, and two sets of legs 30*a*, 30*b* and 40*a*, 40*b* for supporting the holder member 20 by its opposite ends over the base member 30. The base member 10 has opposite ends spaced apart by a length L in a lateral direction and has a depth L1 in a depthwise direction. The holder member 20 is supported by a given height L2 in a vertical direction over the base member and has opposite ends spaced apart by the length L in the lateral direction. The pair of legs 30*a*, 30*b* at the right-side end of the holder are arranged upright in parallel and spaced apart in the depthwise direction, and have first ends pivotably mounted at pivot points 31*a*, 31*b*, respectively, to the base member 10, and second ends pivotably mounted at pivot points 32*a*, 32*b*, respectively, to the holder member 20. Similarly, the pair of legs 40*a*, 40*b* at the left-side end of the holder have first ends mounted at pivot points 41*a*, 41*b*, respectively, to the base member 10, and second ends mounted at pivot points 42*a*, 42*b*, respectively, to the holder member 20.

Each of the legs 30*a*, 30*b* and 40*a*, 40*b* have the same thickness T, and the pivot points of each pair of legs are offset from each other in the vertical direction by the same thickness T of the legs. As shown in FIG. 2, this allows the two sets of legs to be fold downward in a flat, horizontal position for storage. The base member 10 and the holder member 20 both have the same thickness H which preferably is twice the thickness T of the legs, so that the entire assembly has a single thickness H when folded flat for storage.

In the preferred embodiment, the holder member 20 has a number (e.g., three) of clips or rings 21*a*, 21*b*, 21*c* defining respective bays for holding multiple pots or containers. The rings are connected together by intermediate spacers 22*b*, 22*c* and to end spacers 22*a*, 22*d*. The end spacers are pivotably mounted to the ends of the two sets of legs 30*a*, 30*b* and 40*a*, 40*b* at the offset pivot points 32*a*, 32*b* and 42*a*, 42*b*, respectively, so that the holder member 20 can pivot to the flat, horizontal position for storage. Intermediate support members 23 and 24 are provided for bracing the holder member 20 at the intermediate positions of the spacers 22*b* and 22*c*. The intermediate support members 23 and 24 are preferably formed from a flat metal piece and bent at their opposite edges to form outer rails. The outer rails have lower pivot points 23*a* and 24*a* located at a slight eccentric position (equal to the thickness of the metal piece) so that the intermediate support members 23 and 24 can be pivoted downward flat on the base member 10. The outer rails also have upper pairs of upright tabs 23*b* and 24*b* that fit snugly onto opposite sides of the spacers 22*b* and 22*c*, respectively, in order to lock the holder member 20 and legs in the vertical position during use.

The height L2 that the holder member 20 is supported over the base member 10 should be longer than the depth Ll of the base member 10 in the depthwise direction, in order to allow the holder member 20 to pivot downward with ample clearance over the thickness H of the base member 10. For example, the height L2 may be six inches, the depth Ll four inches, and the thickness H two inches. The total height LT of the holder structure is ten inches, and the thickness T of the legs 30*a*, 30*b* and 40*a*, 40*b* is one inch, in this example. As shown in FIG. 2, the bottom ends of the legs are formed with a half-radius HR to allow the legs to be pivoted to the vertical position, and not move past the vertical position.

For hot food or beverage service, holder pits 25*a*, 25*b*, 25*c* for fuel cans may be formed in the base member 10 beneath the respective bays of the holder member 20. The base member 10 may have extension legs or base plates 15*a*, 15*b* for bracing the entire holder structure in the depthwise direction from tipping. In this embodiment, the extension legs are formed with end hooks for hooking onto a shelf of a food service table. A sliding lock may be provided at one end for snug installation over shelves of different widths. The extension legs may also be screwed onto or lie flat on a food service table.

Figure 3:
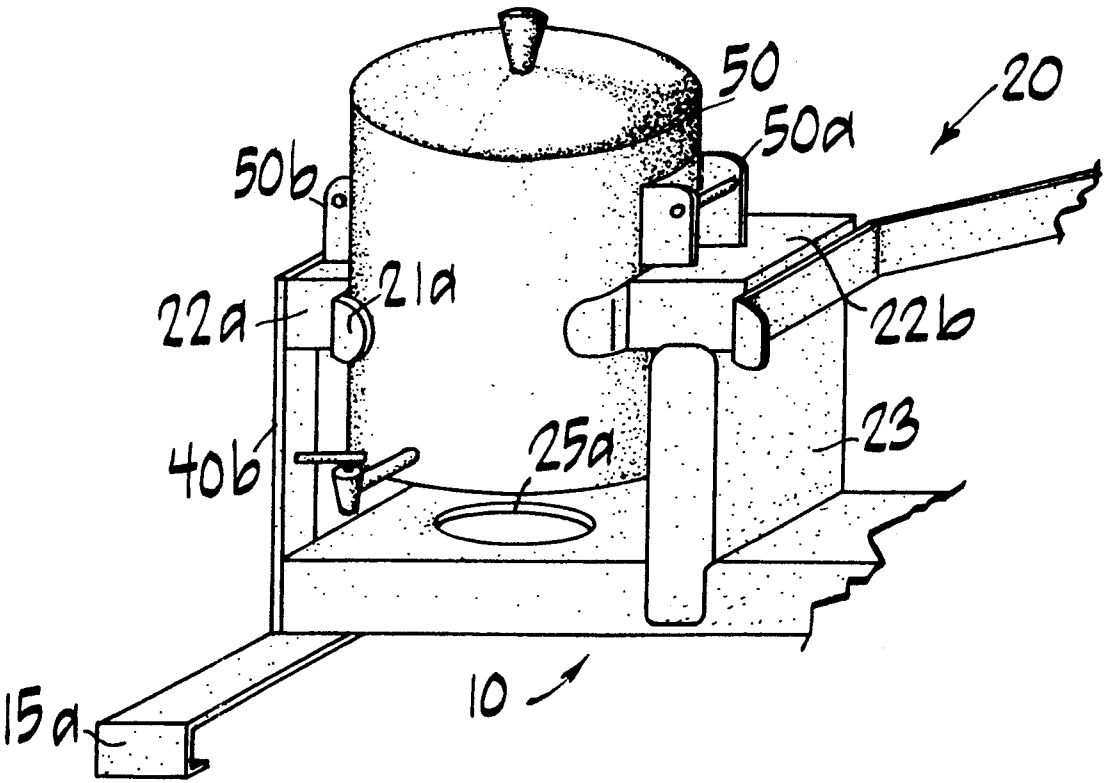
FIG. 3 the multi-pot holder in use holding a pot for hot food or beverage service.

As shown in use in FIG. 3, the multi-pot holder can hold a beverage pot or urn 50 over the flame of a fuel can situated in the holder pit 25*a*. The pot 50 is supported above the fuel can by resting its handles or ears 50*a*, 50*b* on the spacers 22*a*, 22*b*. For non-standard containers which do not have handles or ears at the correct height over the fuel can, a metal strap may be tightened around the container with projections positioned for resting on the spacers. The holder member 20 may likewise be used to support hot food trays.

With the above-described construction, a multi-pot holder is provided which can hold a number of pots, containers, or trays for hot beverage or food service. The holder is readily assembled for use and locked in the upright position by the tabs of the intermediate support members. It folds flat to a single thickness in the horizontal position for convenient storage. Its holding, locking, and folding functions are provided using a minimal number of parts which are inexpensive to fabricate and assemble.

Although the invention has been described with reference to certain preferred embodiments, it will be appreciated that many variations and modifications may be made consistent with the broad principles of the invention. It is intended that the preferred embodiments and all of such variations and modifications be included within the scope and spirit of the invention, as defined in the following claims.

I claim:

1. A folding multi-pot holder comprising:

a base member having opposite ends spaced apart by a given length in a lateral direction and having a given depth in a depthwise direction and a given thickness in a vertical direction perpendicular to the lateral and depthwise directions;

a holder member spaced apart from the base member by a given height in the vertical direction and having opposite ends spaced apart by the given length in the lateral direction and a given thickness in the vertical direction; and two sets of upright legs positioned respectively at the opposite ends of the base member and holder member for supporting the holder member in the vertical direction over the base member, wherein each set includes a pair of legs arranged upright in the vertical direction and spaced apart in parallel in the depthwise direction, each leg of said pair of legs having a given thickness in the depthwise direction and having a first end thereof pivotably mounted at a respective pivot point to a respective end of said base member and a second end thereof pivotably mounted at a respective pivot point to a respective end of said holder member, wherein the pivot points of each pair of legs mounted to the ends of said base member and said holder member are offset from each other by the given thickness in the vertical direction, such that the two pairs of legs with said holder member can be pivotally folded on said base member from the vertical direction to a flat, horizontal position in the depthwise direction for storage, and further wherein said base member and holder member both have the same thickness, and each leg of each pair of legs has the same thickness as the other leg which is one-half the thickness of the base member and of the holder member, such that when each pair of legs are folded to the horizontal position, the legs overlie each other and their combined thickness in the vertical direction is the same as the thickness of the base and holder members, whereby the entire assembly of the base and holder members and said pairs of legs all have the same thickness when folded to the horizontal position for storage.

2. A multi-pot holder according to claim 1, wherein intermediate support members are provided for bracing the holder member at intermediate positions and are pivotably mounted on the base member, so that they can be folded flat on the base member for storage.

3. A folding multi-pot holder comprising:

a base member having opposite ends spaced apart by a given length in a lateral direction and having a given depth in a depthwise direction;

a holder member spaced apart from the base member by a given height in a vertical direction and having opposite ends spaced apart by the given length in the lateral direction; and two sets of upright legs positioned respectively at the opposite ends of the base member and holder member for supporting the holder member in the vertical direction over the base member, wherein each set includes a pair of legs arranged upright in the vertical direction and spaced apart in parallel in the depthwise direction, each leg of said pair of legs having a given thickness in the depthwise direction and having a first end thereof pivotably mounted at a respective pivot point to a respective end of said base member and a second end thereof pivotably mounted at a respective pivot point to a respective end of said holder member, and further wherein the pivot points of each pair of legs mounted to the ends of said base member and said holder member are offset from each other by the given thickness in the vertical direction, such that the two pairs of legs with said holder member can be pivotally folded on said base member from the vertical direction to a flat, horizontal position in the depthwise direction for storage, wherein intermediate support members are provided for bracing the holder member at intermediate positions and are pivotably mounted on the base member, so that they can be folded flat on the base member for storage, and wherein the holder member is formed with a series of rings defining bays for holding a plurality of pots and intermediate spacers connecting adjacent rings.

4. A multi-pot holder according to claim 3, wherein the number and position of the intermediate spacers correspond to, and are supported by, the intermediate support members.

5. A multi-port holder according to claim 4, wherein the intermediate support members each have a pair of upright tabs that fit snugly onto opposite sides of the respective intermediate spacer in the depthwise direction in order to lock the holder ember and legs in a vertical position during use.

6. A multi-pot holder according to claim 3, wherein the base member is formed with holders for fuel cans for heating pots held in the bays defined by said rings.

7. A folding multi-pot holder comprising:

a base member having opposite ends spaced apart by a given length in a lateral direction and having a given depth in a depthwise direction;

a holder member spaced apart from the base member by a given height in a vertical direction and having opposite ends spaced apart by the given length in the lateral direction; and two sets of upright legs positioned respectively at the opposite ends of the base member and holder member for supporting the holder member in the vertical direction over the base member, wherein each set includes a pair of legs arranged upright in the vertical direction and spaced apart in parallel in the depthwise direction, each leg of said pair of legs having a given thickness in the depthwise direction and having a first end thereof pivotably mounted at a respective pivot point to a respective end of said base member and a second end thereof pivotably mounted at a respective pivot point to a respective end of said holder member, and further wherein the pivot points of each pair of legs mounted to the ends of said base member and said holder member are offset from each other by the given thickness in the vertical direction, such that the two pairs of legs with said holder member can be pivotally folded on said base member from the vertical direction to a flat, horizontal position in the depthwise direction for storage, wherein the base member is provided with extension legs in the depthwise direction for holding the entire assembly from tipping during use, and wherein the ends of the legs pivotably mounted to the base member pivot in contact with the extension legs and have half radii to allow the legs to pivot on the extension legs to, and not beyond, the vertical position.

8. A multi-pot holder according to claim 1 further comprising locking means for locking the holder member and legs in their vertical positions.

* * * * *